US011004589B2

(12) United States Patent
Lin et al.

(10) Patent No.: US 11,004,589 B2
(45) Date of Patent: May 11, 2021

(54) HIGH-Q INTEGRATED INDUCTOR AND METHOD THEREOF

(71) Applicant: Realtek Semiconductor Corp., Hsinchu (TW)

(72) Inventors: Chia-Liang (Leon) Lin, Fremont, CA (US); I-Chang Wu, Fremont, CA (US); Fei Song, San Jose, CA (US)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 139 days.

(21) Appl. No.: 15/964,218

(22) Filed: Apr. 27, 2018

(65) Prior Publication Data

US 2019/0333672 A1 Oct. 31, 2019

(51) Int. Cl.
*H01F 17/00* (2006.01)
*H01F 41/04* (2006.01)

(52) U.S. Cl.
CPC ..... *H01F 17/0013* (2013.01); *H01F 41/041* (2013.01); *H01F 2017/008* (2013.01); *H01F 2017/0053* (2013.01); *H01F 2017/0073* (2013.01); *H01F 2017/0086* (2013.01)

(58) Field of Classification Search
CPC ..... H01F 17/0006; H01F 2017/008; H01F 2017/0086
See application file for complete search history.

(56) References Cited

U.S. PATENT DOCUMENTS 6,833,603 B1 * 12/2004 Park ..... H01F 17/0006
6,905,889 B2 6/2005 Lowther
2002/0113290 A1 * 8/2002 Lemaire ..... H01F 17/0006 257/528
2004/0007760 A1 * 1/2004 Lowther ..... H01L 27/08 257/531
2005/0128038 A1 * 6/2005 Hyvonen ..... H01F 17/0013 336/182
2006/0163692 A1 * 7/2006 Detecheverry ..... H01L 23/5222
2007/0268093 A1 * 11/2007 Lim ..... H01L 23/5227
2008/0029854 A1 * 2/2008 Hung ..... H01L 23/5225 257/659

(Continued)

*Primary Examiner* — Elvin G Enad
*Assistant Examiner* — Malcolm Barnes
(74) *Attorney, Agent, or Firm* — McClure, Qualey & Rodack, LLP

(57) ABSTRACT

A device having a substrate, a dielectric slab attached upon the substrate, a coil including a plurality of metal segments laid out on a first metal layer secured by the dielectric slab, the coil being substantially laterally symmetrical with respect to a central line from a top view perspective, and a shield laid out on a second metal layer secured by the dielectric slab and configured in a tree topology. The shield is substantially laterally symmetrical with respect to the central line from the top view perspective, the tree topology including a plurality of clusters of branches, wherein each of said plurality of clusters of branches is associated with a respective metal segment of the coil and includes a primary branch and at least one set of secondary branches that are branched from the primary branch, parallel to one another, and oriented at a substantially forty-five-degree angle with respect to the respective metal segment from the top view perspective.

6 Claims, 2 Drawing Sheets

(56) References Cited

U.S. PATENT DOCUMENTS

| | | | | |
|---|---|---|---|---|
| 2008/0074229 | A1* | 3/2008 | Moinian | H01F 17/0006 336/200 |
| 2009/0250262 | A1* | 10/2009 | Jin | H01L 23/5227 174/384 |
| 2010/0182116 | A1* | 7/2010 | Ishimoto | H01F 17/0006 336/192 |
| 2010/0193904 | A1* | 8/2010 | Watt | H01L 28/10 257/531 |
| 2011/0076979 | A1* | 3/2011 | Wu | H01F 17/0006 455/318 |
| 2011/0116208 | A1* | 5/2011 | Signoff | H01G 4/002 361/301.1 |
| 2012/0242446 | A1* | 9/2012 | Wu | H01F 17/0006 336/192 |
| 2014/0117496 | A1* | 5/2014 | Cheng | H01L 23/552 257/531 |
| 2014/0361417 | A1* | 12/2014 | Liu | H01L 23/5225 257/659 |
| 2016/0218169 | A1* | 7/2016 | Yen | H01L 28/10 |
| 2017/0033059 | A1* | 2/2017 | Song | H01L 23/585 |
| 2017/0076857 | A1* | 3/2017 | Huang | H05K 1/0218 |
| 2017/0359097 | A1* | 12/2017 | Uchida | H01L 28/10 |

* cited by examiner

HIGH-Q INTEGRATED INDUCTOR AND METHOD THEREOF

BACKGROUND OF THE DISCLOSURE

Field of the Disclosure

The present disclosure generally relates to integrated inductors, and more particularly to integrated inductors having a high quality factor (Q factor).

Description of Related Art

A conventional integrated inductor comprises a coil laid out on a metal layer secured by a dielectric slab attached on a substrate. A high Q factor is usually highly desirable for an integrated inductor, as it is a measure of how effectively the integrated inductor preserves energy. A substrate loss usually leads to appreciable energy loss and thus degradation of the Q factor. The substrate loss includes both Ohmic loss and Eddy current loss. The Ohmic loss results from an electric field coupling between the coil and the substrate, while the Eddy current loss results from a magnetic field coupling. A shielding structure can be inserted between the coil and the substrate on another metal layer housed by the dielectric slab to reduce electric and/or magnetic field coupling and thus substrate loss. However, the shielding structure itself could lead to energy loss of itself. To prevent Eddy current loss on the shielding structure of itself, the shielding structure is often configured to be perpendicular to the integrated inductor as seen from a top view. This arrangement greatly reduces magnetic field coupling between the coil and the shielding structure and thus the Eddy current loss on the shielding structure, but provides almost no help in reducing the magnetic field coupling between the coil and the substrate. Therefore, the shielding structure provides almost no help in reducing the Eddy current loss in the substrate.

What is desired is a shielding structure that not only has very little energy loss of itself, but also helps to reduce both the Ohmic loss and the Eddy current loss of the substrate.

SUMMARY OF THE DISCLOSURE

In an embodiment, a device comprises: a substrate; a dielectric slab attached upon the substrate; a coil including a plurality of metal segments laid out on a first metal layer secured by the dielectric slab, the coil being substantially laterally symmetrical with respect to a central line from a top view perspective; and a shield laid out on a second metal layer secured by the dielectric slab and configured in a tree topology, the shield being substantially laterally symmetrical with respect to the central line from the top view perspective, the tree topology including a plurality of clusters of branches, wherein each of said plurality of clusters of branches is associated with a respective metal segment of the coil and includes a primary branch and at least one set of secondary branches that are branched from the primary branch, parallel to one another, and oriented at a substantially forty-five-degree angle with respect to the respective metal segment as seen from the top view.

In an embodiment, a method includes the following steps: attaching a dielectric slab on top of a substrate; deploying a coil including a plurality of metal segments laid out on a first metal layer secured by the dielectric slab, the coil being substantially laterally symmetrical with respect to a central line from a top view perspective; and deploying a shield on a second metal layer secured by the dielectric slab, wherein:

the shield is configured in a tree topology and substantially laterally symmetrical with respect to the central line from the top view perspective, the tree topology includes a plurality of clusters of branches, and each of said plurality of clusters of branches is associated with a respective metal segment of the coil and includes a primary branch and at least one set of secondary branches that are branched from the primary branch, parallel to one another, and oriented at a substantially forty-five degree angle with respect to the respective metal segment as seen from the top view.

DETAILED DESCRIPTION OF THIS DISCLOSURE

The present disclosure is directed to integrated inductors. While the specification describes several example embodiments of the disclosure considered favorable modes of practicing the invention, it will be understood by persons skilled in the art that the invention can be implemented in many ways and is not limited to the particular examples described below or to the particular manner in which any features of such examples are implemented. In other instances, well-known details are not shown or described to avoid obscuring aspects of the disclosure.

Persons of ordinary skill in the art understand terms and basic concepts related to microelectronics that are used in this disclosure, such as "substrate," "dielectric slab," "inductor," "electric field coupling," "magnetic field coupling," "current," "voltage," "Ohmic loss," "Eddy current," "AC (alternate current) ground," "differential signaling." Terms and basic concepts like these are apparent to those of ordinary skill in the art and thus will not be explained in detail here.

This disclosure is presented in an engineering sense, instead of a rigorous mathematical sense. For instance, "A is zero" means "A is smaller than an engineering tolerance of interest."

Figure 1:
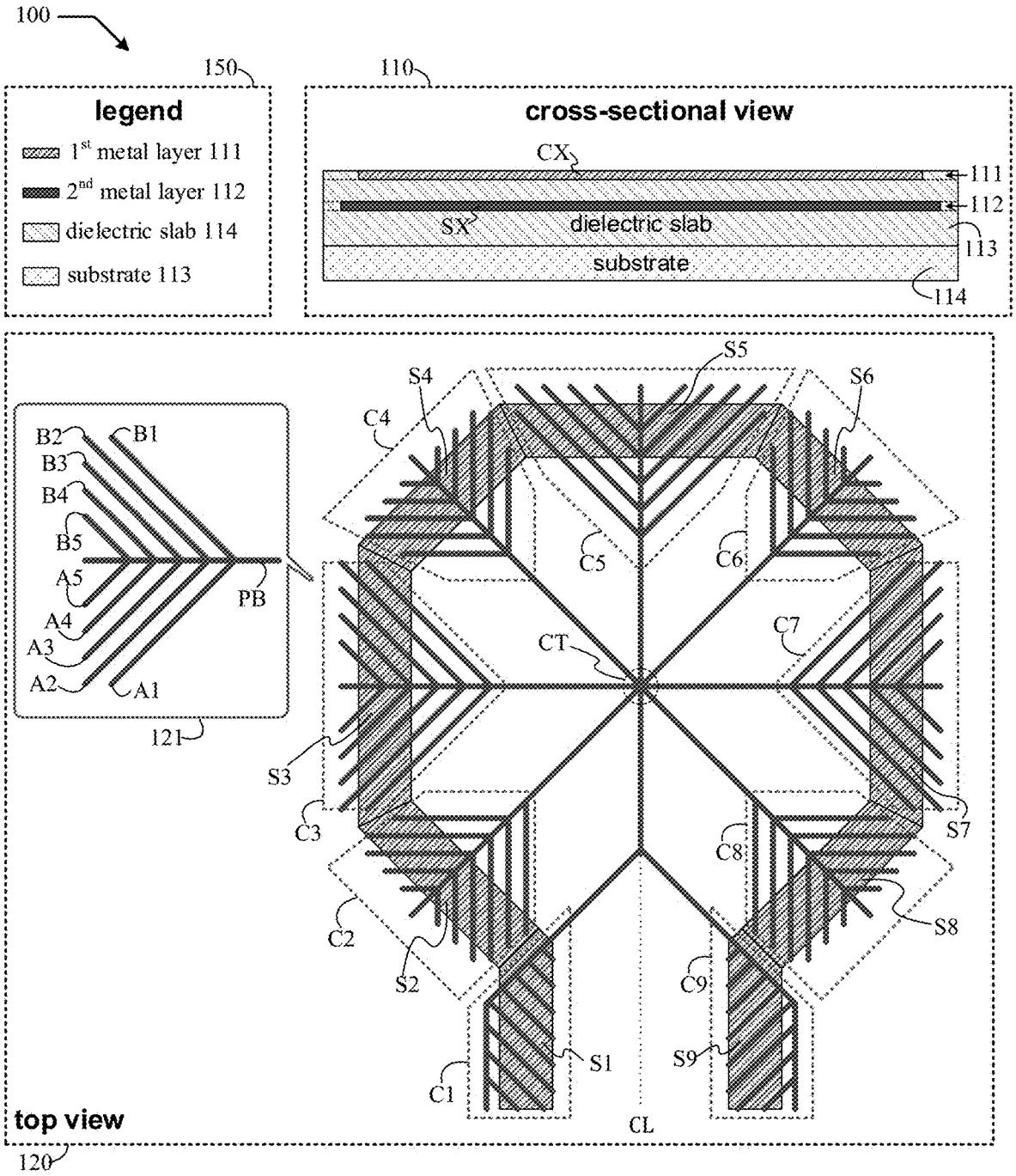
FIG. 1 shows a cross-sectional view, a top view, and a legend of a layout of an integrated inductor in accordance with an embodiment of the present disclosure.

As illustrated by a cross-sectional view shown in box 110 in FIG. 1, an integrated inductor 100 comprises a coil CX laid out on a first metal layer 111, and a shield SX laid out on a second metal layer 112, wherein both the first metal layer 111 and the second metal layer 112 are secured by a dielectric slab 113 attached upon a substrate 114. A top view is shown in box 120, and a legend is shown in box 150. As shown in the top view, the coil CX is of a loop topology and comprises a plurality of metal segments S1, S2, S3, . . . , S9 electrically connected to allow a current to flow through and excite a magnetic flux, while the shield SX is of a tree topology and comprises a plurality of clusters of branches C1, C2, C3, . . . , C9 electrically connected to provide an isolation between the coil CX and the substrate 114. Each cluster (of branches) comprises a primary branch and at least one set of secondary branches branched from the primary branch, wherein the secondary branches within the same set are parallel to one another.

As shown in callout box 121, for instance, cluster C3 comprises a primary branch PB, a first set of secondary branches A1, A2, A3, A4, and A5 that are branched from the primary branch PB and parallel to one another, and a second set of branches B1, B2, B3, B4, and B5 that are also branched from the primary branch PB and parallel to one another. All branches, primary or secondary, are thin metal lines. Each cluster (of branches) of the shield SX is associated with a metal segment of the coil CX. For instance, cluster C1 (C2, C3, C4, C5, C6, C7, C8, C9) is associated with metal segment S1 (S2, S3, S4, S5, S6, S7, S8, S9). All secondary branches within a cluster are oriented at substantially a 45 degree-angle with respect to the metal segment that the cluster is associated with. For instance, all secondary branches of cluster C3 are oriented at a 45-degree angle with respect to metal segment S3. Since all the secondary branches of a cluster are at a 45-degree angle with respect to the metal segment that the cluster is associated with, a certain magnetic field coupling takes place between the metal segment and the associated cluster, which helps to provide a certain degree of shielding and mitigate a magnetic field coupling between the metal segment and the substrate 114. As a result, an Eddy current loss on the substrate 114 is reduced. Although the magnetic field coupling between the cluster and the associated metal segment could induce an Eddy current on the cluster and lead to energy loss, the Eddy current loss is very small as a result of the tree topology of the shield SX, wherein most metal lines within are localized within a cluster and all metal lines are open-ended branches and therefore a long loop of current conduction path is avoided. All primary branches emanate from a center point CT (see inside box 120 in FIG. 1), resulting in a balanced tree that is substantially laterally symmetrical with respect to a central line CL. The coil CX is also laid out to be substantially laterally symmetrical with respect to the central line CL. Due to the symmetry, an electric field coupling from the left hand side of the coil CX (with respect to the central line CL) will always be cancelled by an electric field coupling from the right hand side of the coil CX in a differential signaling scheme of interest wherein two voltage signals of opposite polarities are applied to the two ends of the coil CX (one at metal segment S1 and the other at metal segment S9), respectively. Consequently, the net electric field coupled from the coil CX to the shield SX is zero, and the shield SX is virtually an AC ground. As a result, there is zero electric field coupled to the substrate 114 and thus zero Ohmic loss therein. In summary, the shield SX can provide nearly perfect electrical field isolation along with certain magnetic field isolation, and does not contribute significant energy loss of itself. This allows the integrated inductor 100 to have a high Q factor.

Each of clusters C2, C3, C4, C5, C6, C7, and C8 has two sets of secondary branches that are substantially balanced with respect to the primary branch therein. In contrast, each of clusters C1 and C9 has only one set of secondary branches branched out from one side of the primary branch therein. This arrangement is chosen based on convenience, instead of technical constraint.

Note that if the secondary branches were perpendicular to the associated metal segment, they would provide almost no magnetic field isolation and thus no help in reducing the Eddy loss of the substrate. On the other hand, if the secondary branches were parallel to the associated metal segment, the magnetic field isolation would be strong, but the shield itself might have led to appreciable Eddy current loss. In comparison, using clustered, substantially a 45-degree angled, open-ended branches helps to reduce the Eddy current loss of the substrate, but causes very little Eddy current loss of itself, and thus realizes the preferred arrangement.

Integrated inductor 100 is a single-turn inductor, but the technique of using a tree-structured shield with clustered branches that are oriented at a 45-degree angle with respect to associated metal segments of the inductor can be applied to many embodiments of an integrated inductor.

Figure 2:
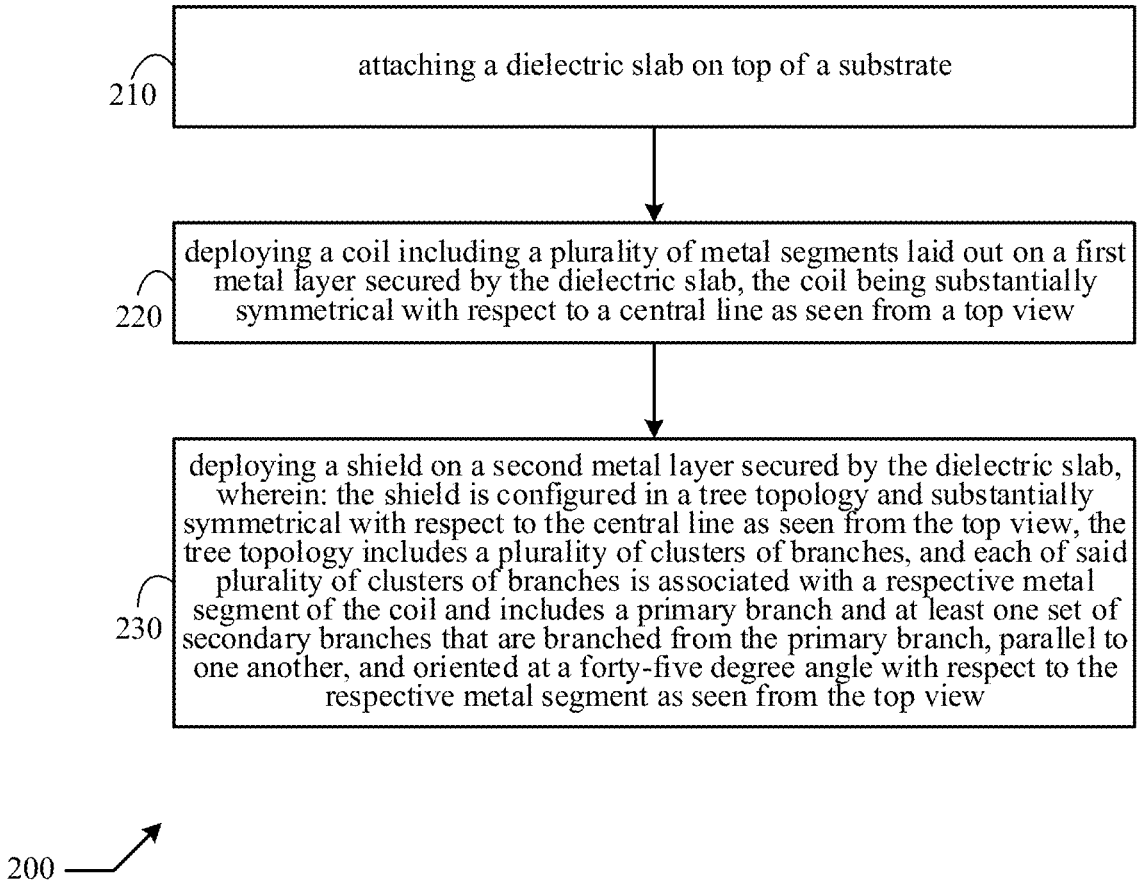
FIG. 2 shows a flow diagram of a method in accordance with an embodiment of the present invention.

As illustrated by a flow diagram 200 shown in FIG. 2, a method in accordance with an embodiment of the present invention includes the following steps: (step 210) attaching a dielectric slab on top of a substrate; (step 220) deploying a coil including a plurality of metal segments laid out on a first metal layer secured by the dielectric slab, the coil being substantially laterally symmetrical with respect to a central line from a top view perspective; and (step 230) deploying a shield on a second metal layer secured by the dielectric slab, wherein: the shield is configured in a tree topology and substantially laterally symmetrical with respect to the central line from the top view perspective, the tree topology includes a plurality of clusters of branches, and each of said plurality of clusters of branches is associated with a respective metal segment of the coil and includes a primary branch and at least one set of secondary branches that are branched from the primary branch, parallel to one another, and oriented at a substantially forty-five degree angle with respect to the respective metal segment from the top view perspective.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A device comprises:

a substrate;

a dielectric slab attached upon the substrate;

a coil including a plurality of metal segments substantially forming a loop laid out on a first metal layer secured by the dielectric slab, the coil being substantially laterally symmetrical with respect to a central line from a top view perspective; and a shield laid out on a second metal layer secured by the dielectric slab and configured in a tree topology, the shield being substantially laterally symmetrical with respect to the central line from the top view perspective, the tree topology including a plurality of clusters of branches, wherein each of said plurality of clusters of branches is associated with a respective metal segment of the coil and includes a primary branch and at least one set of secondary branches that are branched from the primary branch, parallel to one another, and oriented at a substantially forty-five-degree angle with respect to the respective metal segment from the top view perspective, wherein the plurality of primary branches emanate out from a center point and secondary branches extend from the primary branches only in locations where the secondary branches overlap with the coil, such that a distance exists along each primary branch, closest to the center point, along which no secondary branch extends.

2. The device of claim 1, wherein all primary branches emanate from a center point located at the central line.

3. The device of claim 1, wherein at least one cluster of said plurality of clusters of branches include two sets of secondary branches.

4. The device of claim 3, wherein the two sets of secondary branches are substantially balanced with respect to the primary branch therein.

5. The device of claim 1, wherein the primary branch and all secondary branches of any cluster of said plurality of clusters of branches are open-ended metal lines that are substantially narrower than the associated respective metal segment.

6. A device comprises:

a substrate;

a dielectric slab attached upon the substrate;

a coil including a plurality of metal segments substantially forming a loop laid out on a first metal layer secured by the dielectric slab, the coil being substantially laterally symmetrical with respect to a central line from a top view perspective; and a shield laid out on a second metal layer secured by the dielectric slab and configured in a tree topology, the shield being substantially laterally symmetrical with respect to the central line from the top view perspective, the tree topology including a plurality of clusters of branches, wherein each of said plurality of clusters of branches is associated with a respective metal segment of the coil and includes a primary branch and at least one set of secondary branches that are branched from the primary branch, parallel to one another, and oriented at a substantially forty-five-degree angle with respect to the respective metal segment from the top view perspective, wherein each of the secondary branches at least partially overlaps with the coil, and wherein in each cluster the primary branch emanates out from a center point and the secondary branches of extend from the primary branch only in locations where the secondary branches overlap with the coil, such that a distance exists along each primary branch, closest to the center point, along which no secondary branch extends.

* * * * *